US005560633A

United States Patent [19]

McGowan

[11] Patent Number: 5,560,633

[45] Date of Patent: Oct. 1, 1996

[54] DOWNHILL SKI BINDING ADAPTER

[76] Inventor: Bruce McGowan, 4845 W. Moorhead Cir., Boulder, Colo. 80303

[21] Appl. No.: 306,903

[22] Filed: Sep. 14, 1994

[51] Int. Cl.[6] ..... A63L 9/085

[52] U.S. Cl. ..... 280/614; 280/615; 280/633; 280/607

[58] Field of Search ..... 280/614, 615, 280/607, 617, 618, 633

[56] References Cited

U.S. PATENT DOCUMENTS

| | | | |
|---|---|---|---|
| D. 290,490 | 6/1987 | Napflin | D21/230 |
| 4,157,191 | 6/1979 | Ramer | 280/614 |
| 4,273,355 | 6/1981 | Storandt | 280/618 |
| 4,410,200 | 10/1983 | Napflin | 280/614 |
| 4,441,732 | 4/1984 | Napflin | 280/614 |
| 4,513,988 | 4/1985 | Svoboda | 280/618 |
| 4,674,766 | 6/1987 | Ramer | 280/614 |
| 5,318,320 | 6/1994 | Ramer | 280/614 |

FOREIGN PATENT DOCUMENTS

| | | | |
|---|---|---|---|
| 197808 | 8/1978 | Germany | 280/614 |

*Primary Examiner*—Richard Camby
*Attorney, Agent, or Firm*—William J. Quinn

[57] ABSTRACT

An improved downhill ski binding adapter, which allows a downhill ski boot to pivot near the toe on a downhill ski with a downhill ski binding, having a structurally stable stationary mount unit and being fully adjustable to accommodate all standard size ski boots and standard downhill ski binding spacings without interference with the downhill ski binding.

11 Claims, 8 Drawing Sheets

DOWNHILL SKI BINDING ADAPTER

BACKGROUND OF THE INVENTION

This invention relates to a downhill ski binding, adapter for allowing a downhill ski boot to be secured to a downhill ski with a downhill ski binding, yet, pivot near the toe and function like a nordic ski, and more particularly to a downhill ski binding adapter having increased performance through improved structural integrity, adjustability to avoid interference problems while in use with various downhill ski bindings, and a size adjustment ability with a sufficient range to accommodate all standard ski boot sizes.

A downhill ski binding adapter allows a downhill ski boot with a downhill ski and a downhill ski binding, to pivot near the toe, upon an axis transverse to the longitudinal axis of the ski, as in nordic skiing; it contains: a stationary mounting portion that is secured in the downhill ski binding as if it were a ski boot itself; a platform pivotally attached to the stationary mounting, to which the downhill ski boot is in turn attached. With a downhill ski binding adapter, the conversion to and from a nordic type pivoting mode requires only that the downhill ski binding adapter be added to or removed from the interface between the ski binding and the downhill ski boot.

As an illustration of a ski binding adapter, U.S. Pat. No. Des. 290,490 to Napflin depicts a ski binding adapter for converting a downhill ski binding to a pivoting nordic type ski binding. The portion of the Napflin device, retained by the downhill ski binding, is adjustable in length through a formed heel piece that slides on a single cylindrical tube and held by a frictional clamp surrounding the cylindrical tube. In the Napflin device, since a single tube is used, length adjustment is limited to less than the length of the heel piece, requiring that the device be made in more than one size to accommodate all standard ski binding spacings. Additionally, no means are provided to assure that the frictional clamp will not slip or rotate while the device is in operation. The pivoting platform portion of the Napflin device, to which the downhill ski boot is secured, contains a toe securing clip and a heel securing latch. The position of the heel securing latch is adjustable to accommodate different sizes of ski boots. No provision is made, in the Napflin device, for altering the position of the toe of the ski boot, to avoid interference between the ski boot and the toe of the downhill ski binding; nor is provision made, for altering the overall length of the pivoting platform to avoid interference between the pivoting platform and the heel piece of the downhill ski binding.

SUMMARY OF THE INVENTION

The present invention provides an adjustable downhill ski binding adapter in which the stationary portion of the downhill ski binding adapter has a length adjustment range sufficient to accommodate all standard ski binding spacings. The present invention also provides a length adjustment means which holds the toe end of the stationary portion of the ski binding adapter at an adjustable distance from the heel end of the stationary portion of the ski binding adapter without slipping. Another feature of the present invention provides rotation arresting means to prevent rotation of the toe end of the stationary portion of the ski binding adapter relative to the heel end of the stationary portion of the ski binding adapter.

The present invention further provides an adjustable downhill ski binding adapter in which the pivoting platform of the downhill ski binding adapter has an adjustable range large enough to accommodate all standard ski boot sizes while preventing interference, during operation, with the downhill ski binding permanently attached to the ski.

BRIEF DESCRIPTION OF THE DRAWINGS

A preferred embodiment of a ski binding adapter with improved performance, stability and expanded compatibility, used to allow a downhill ski with a downhill ski binding to pivot near the toe and function like a nordic ski, is illustrated in the drawings wherein.

DESCRIPTION OF THE PREFERRED EMBODIMENT

Figure 1:
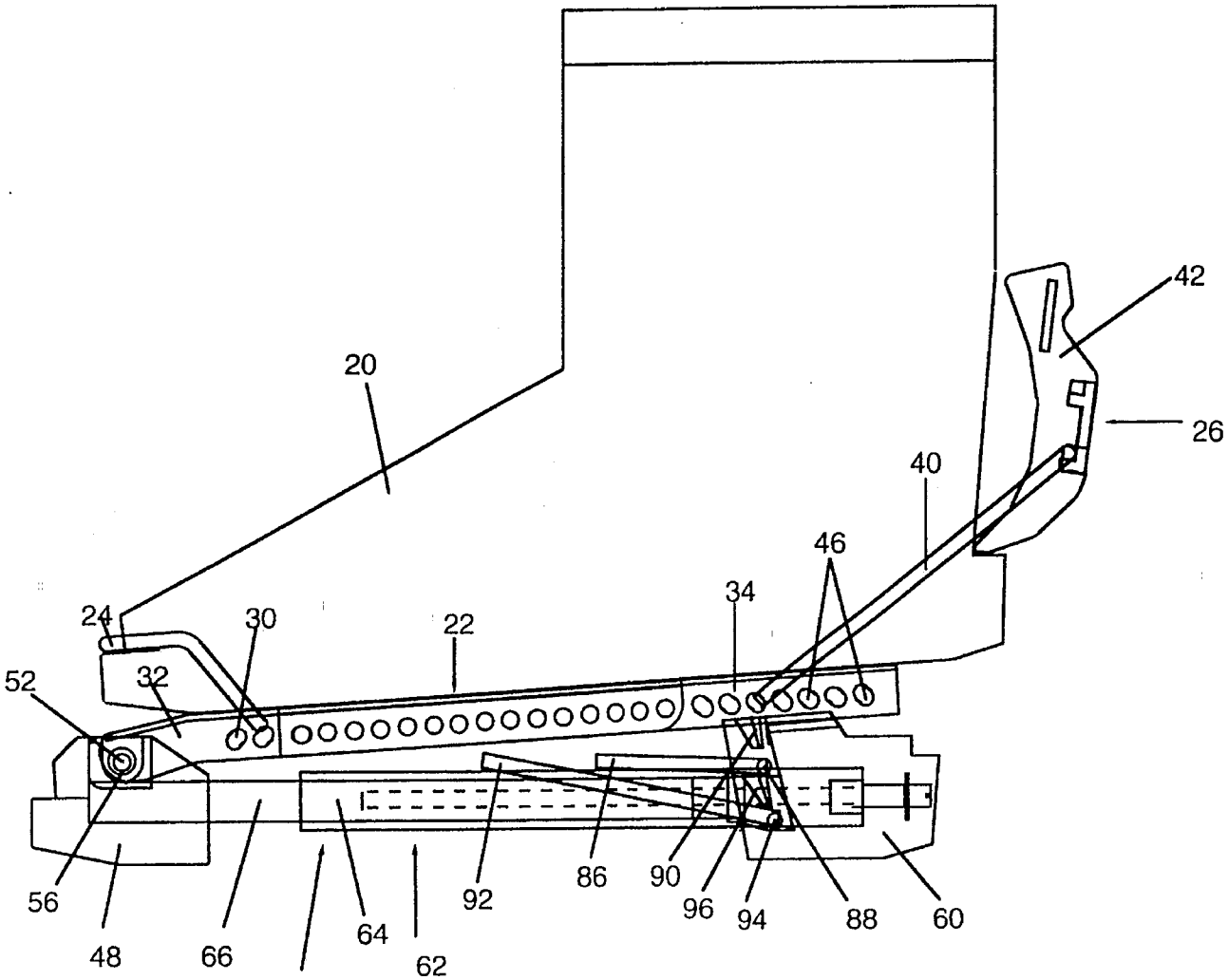
FIG. 1 is a side plan view of the ski binding adapter with a downhill ski boot attached.
Figure 3:
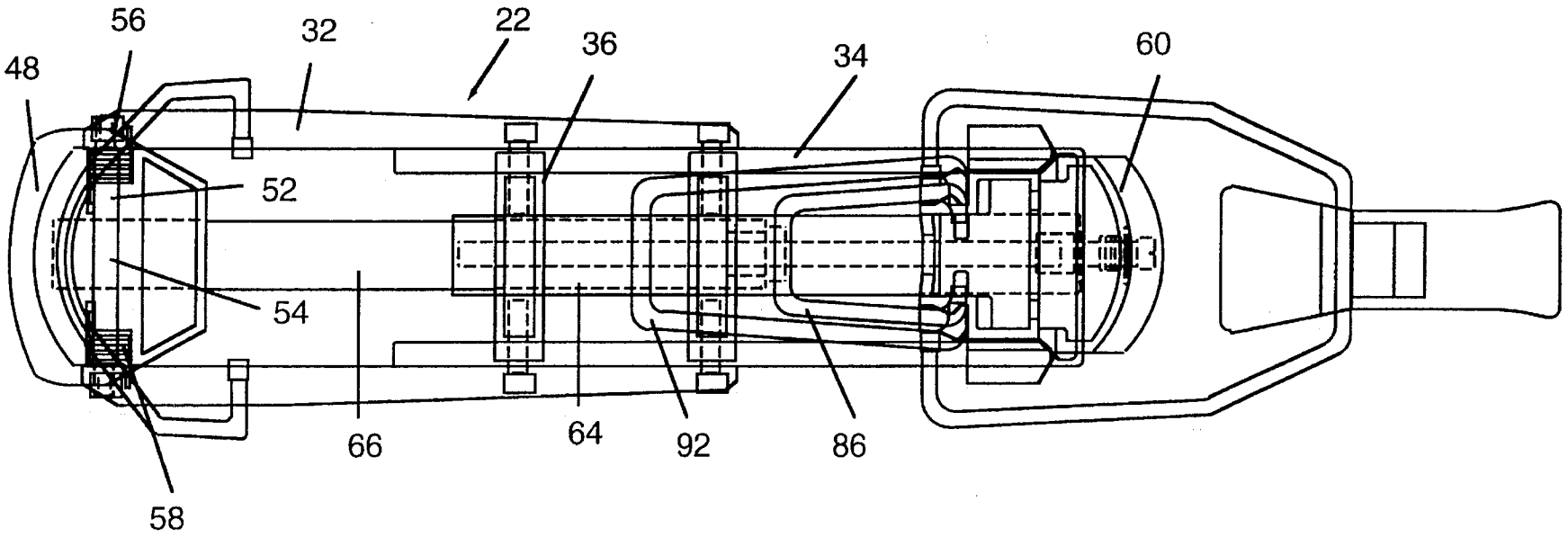
FIG. 3 is a top plan view of the ski binding adapter.
Figure 5:
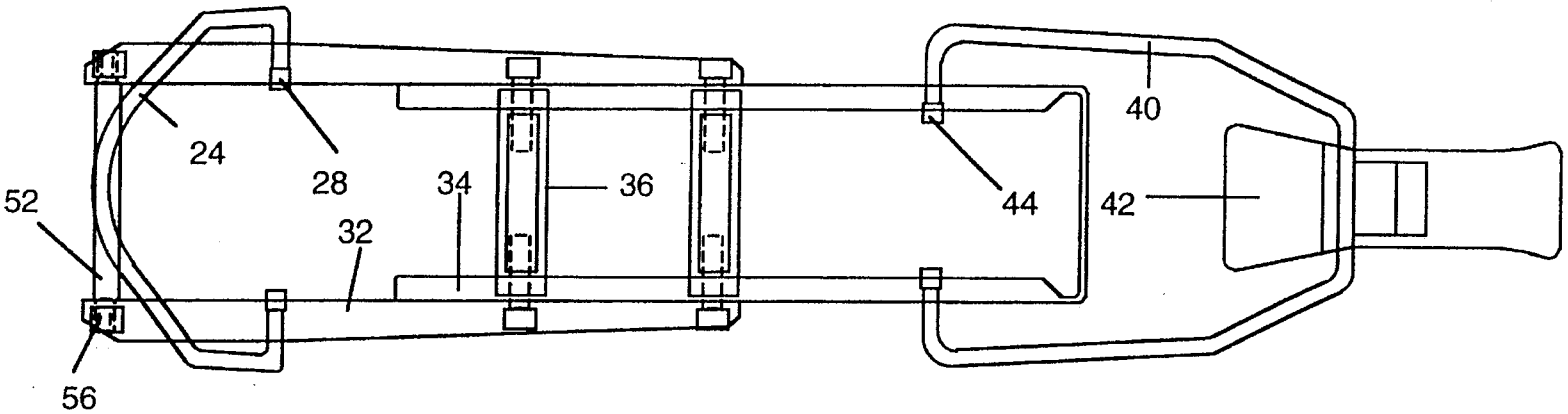
FIG. 5 is a top plan view of the pivoting cage assembly portion of the ski binding adapter.
Figure 7:
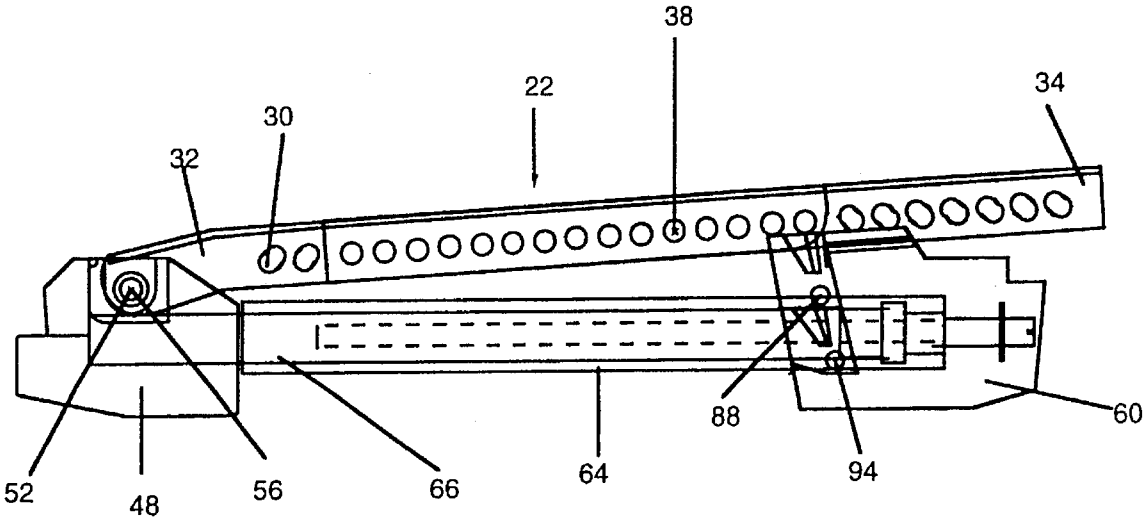
FIG. 7 is a side plan view of the ski binding adapter with both the stationary mount unit and the pivoting cage assembly at minimum length adjustment.
Figure 8:
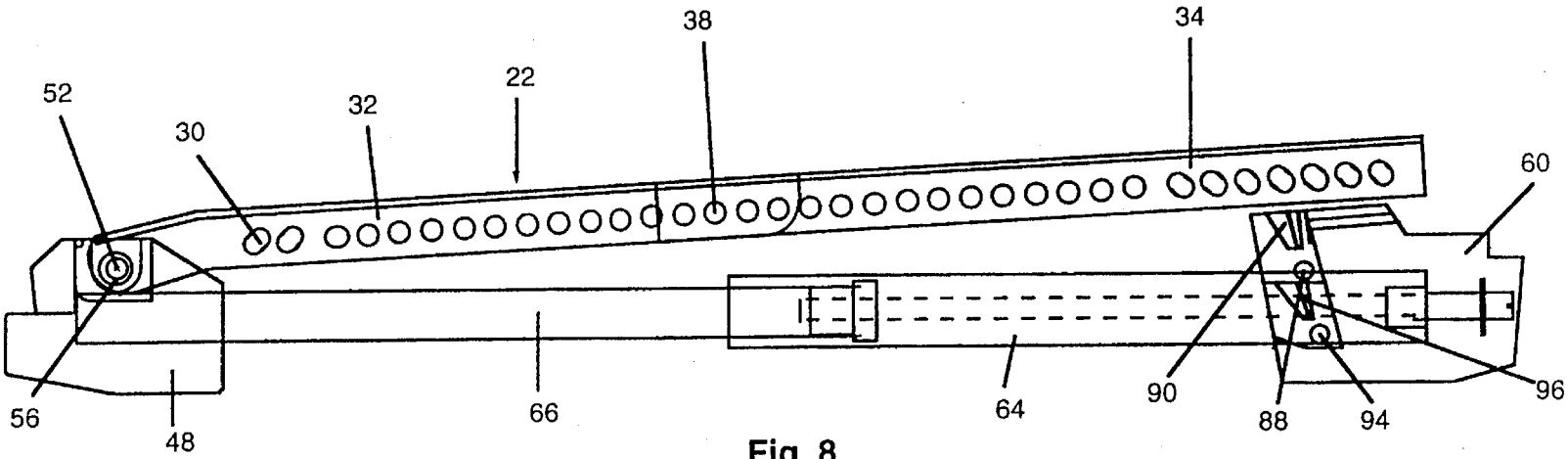
FIG. 8 is a side plan view of the ski binding adapter with both the stationary mount unit and the pivoting cage assembly at maximum length adjustment.

As shown in FIGS. 1, a downhill ski boot 20 is securely attached to a ski boot platform, generally identified by the reference numeral 22, by means of a toe clip 24 and a heel retaining latch, generally identified by the reference numeral 26. The ski boot platform contains toe clip apertures 30. The toe clip 24 has lower ends containing retaining ears 28, as shown in FIG. 3, which interfit within one of a series of pairs of the oval toe clip apertures 30 in the ski boot platform 22 and thereby allow forward and rearward adjustment of the toe clip 24 to prevent interference with various types of downhill ski bindings. The length of the ski boot platform 22 is adjustable and comprises a pair of forward rails 32, attached to a rear rail bracket 34 by a pair of cage fasteners 36, or the like, through any of a series of pairs of adjustment apertures 38 contained in the forward rails 32 and the rear rail bracket 34. The minimum and the maximum length of the ski boot platform are illustrated in FIGS. 7 and 8 respectively, To increase the rigidity of the ski boot platform 22, the forward rails 32 and the rear rail bracket 34 are L shaped in cross section. The heel retaining latch 26 comprises a heel clip 40 pivotally mounted to a heel clamp 42. The lower ends of the heel clip 40 contain retaining ears 44, as depicted in FIG. 3 and interfit within one of a series of pairs of oval heel retaining apertures 46 in the ski boot platform 22 to allow forward and rearward position adjustment of the heel retaining latch 26.

Figure 2:
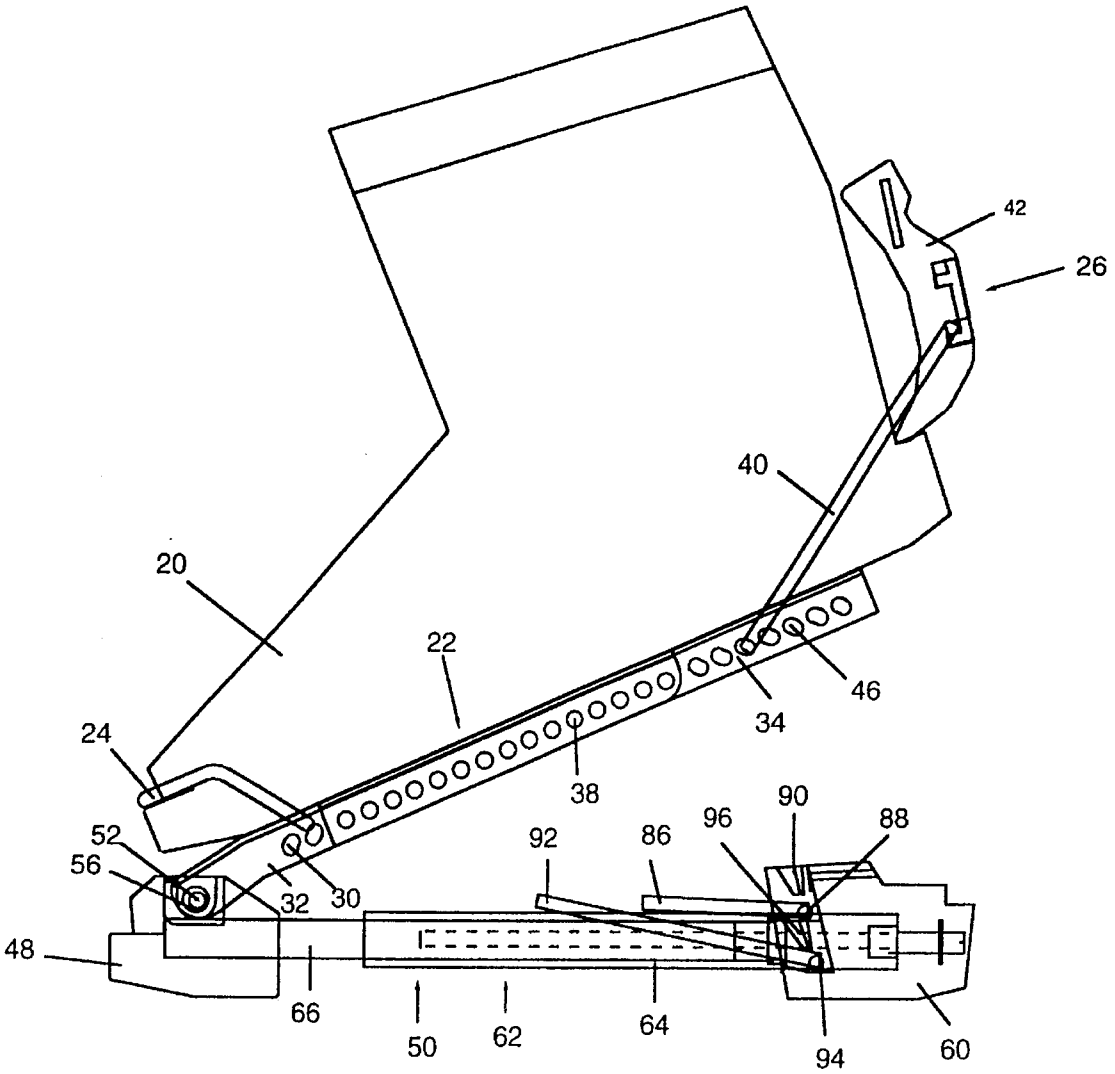
FIG. 2 is a side plan view of the ski binding adapter, with a downhill ski boot attached, in an actively moving pivot position.

Referring to FIG. 3, The ski boot platform 22 is pivotally mounted at its forward end to a toe piece 48 of a stationary mount unit, generally identified by the reference numeral 50, by means of a pivot shaft 52 through a pivot bore 54 and retained by pivot shaft nuts 56. The pivotal axis of the ski boot platform 22 is transverse to the longitudinal axis of the downhill ski boot 20. The ski boot platform 22 is illustrated in different pivotal positions in FIGS. 1 and 2. In order to keep the tail end of a ski from dangling downward as the ski boot 20 is raised from the snow, Resistance to pivotal motion is provided by means of resistance springs 58 mounted about the pivot shaft 52, interior to the forward rails 32, and engaging the toe piece 48 and the forward rails 32.

Figure 4:
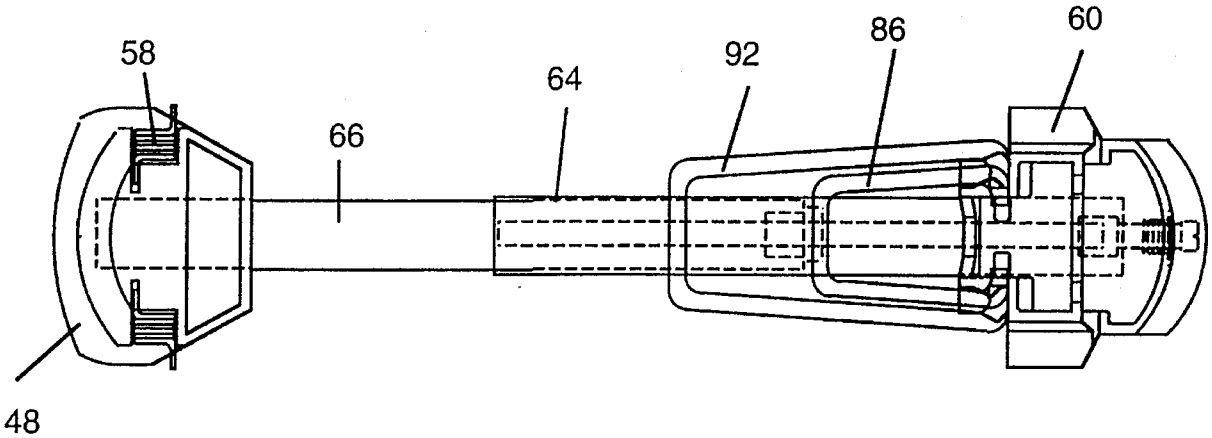
FIG. 4 is a top plan view of the stationary mount unit portion of the ski binding adapter.
Figure 11:
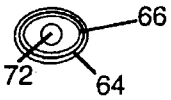
FIG. 11 is a cross sectional view of the telescoping tube assembly of the stationary mount unit of FIG. 4.

Referring to FIG. 4, The stationary mount unit 50, is detachably installed into any ordinary downhill ski binding, comprising the toe piece 48 and a heel piece 60, attached to and separated by, a telescoping tube assembly, generally identified by the reference numeral 62. The forward end of the toe piece 48 and the rearward end of the heel piece 60 are of ASTM standard shape so that they may be installed into any ordinary downhill ski binding. The telescoping tube assembly 62 is constructed of a first tube 64, which is attached to the heel piece 60 and a second tube 66 interior to and engaging the first tube 64 and attached to the toe piece 48. The first tube 64 and the second tube 66 are not round, but are preferably elliptical in cross section, as shown in FIG. 11, so that rotation of the first tube 64 relative to the second tube 66 is prevented, thereby preventing rotation of the toe piece 48 relative to the heel piece 60.

Figure 6:
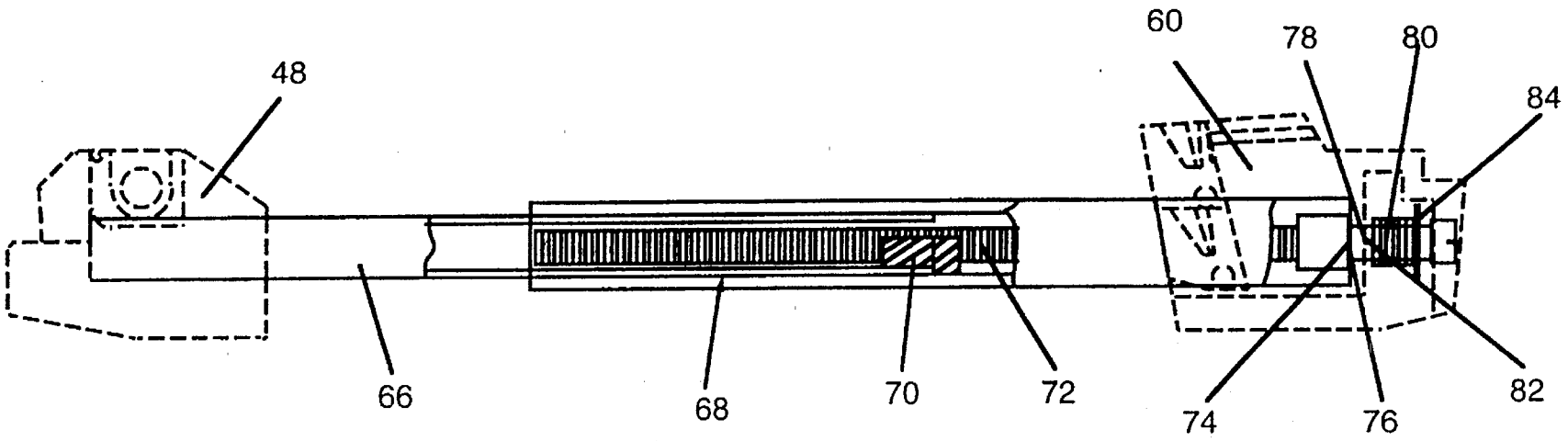
FIG. 6 is a side view of the stationary mount unit portion of the ski binding adapter, showing the length adjustment mechanism in partial section.

The overall distance maintained from the forward end of the toe piece 48 to the rearward end of the heel piece 60 is positively secured and adjusted by means of a threaded shaft assembly, generally identified by the reference numeral 68, and located in the interior of the telescoping tube assembly 62, as shown in FIG. 6. This positively secured adjustment, by means of the threaded shaft assembly 68 allows the ski binding adapter to be easily adjusted to fit different downhill ski binding spacings on different skis, yet does not allow the adjustment to slip and loosen the installation of the Stationary mount unit 50 in the downhill ski binding. The threaded shaft assembly 68 comprises a threaded barrel nut 70, secured in the rearward end of the second tube 66, into which a threaded rod 72 is engaged. The threaded rod 72 is constructed with a shoulder 74 forward of its rearward end which engages a corresponding forward shoulder 76 of an aperture 78 through the heel piece 60, thereby preventing movement of the heel piece 60 and the toe piece 48 toward each other. A tension spring 80 surrounding the rearward end of the threaded rod 72 and engaging a rearward shoulder 82 of the aperture 78 and held in place by a retaining clip 84, resists rotational movement of the threaded rod 72, and prevents movement of the heel piece 60 and the toe piece 48 away from each other.

Figure 9:
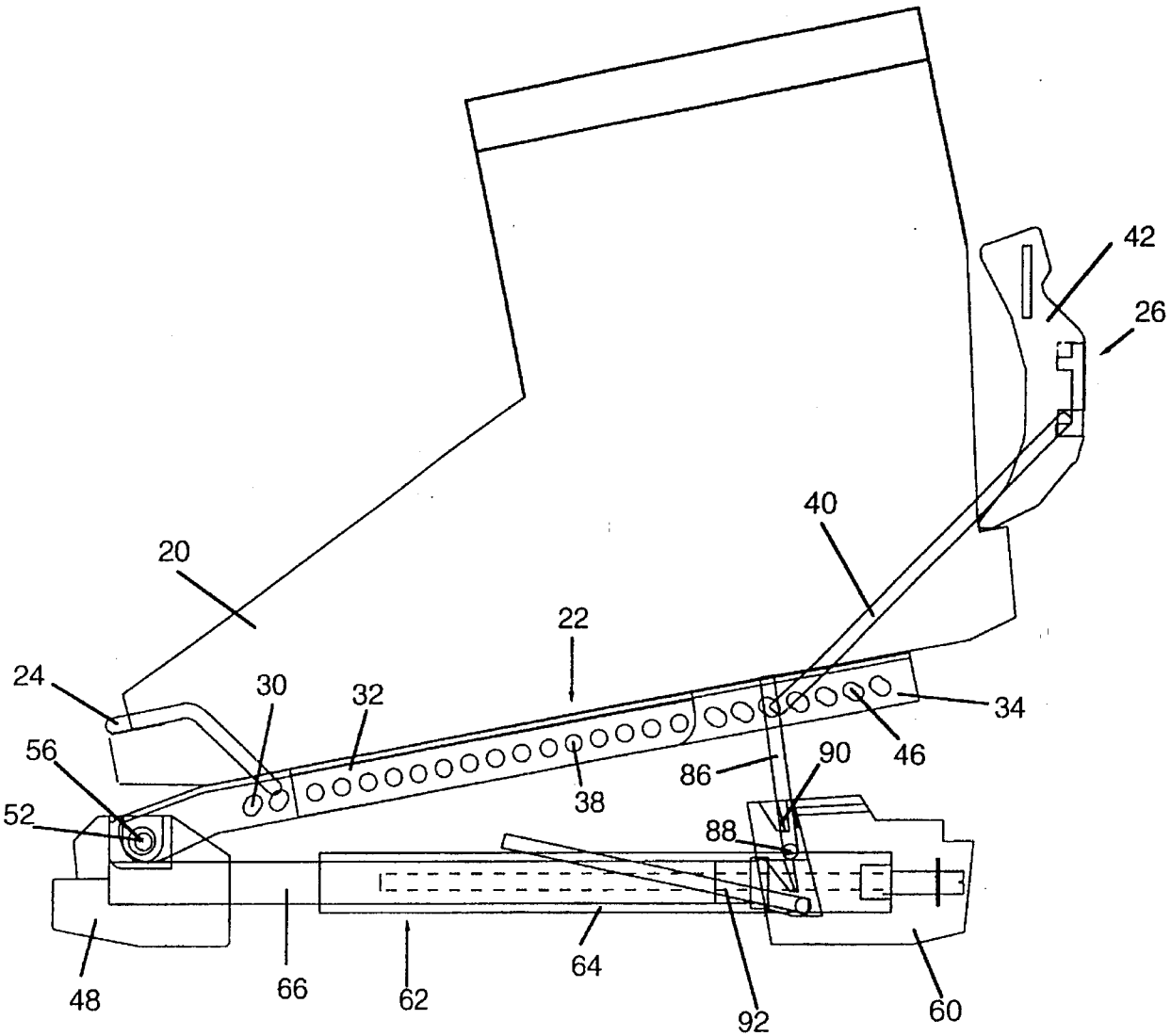
FIGS. 9–10 are side plan views of the ski binding adapter, with a downhill ski boot attached, with pivot limiting televators in two different positions.
Figure 10:
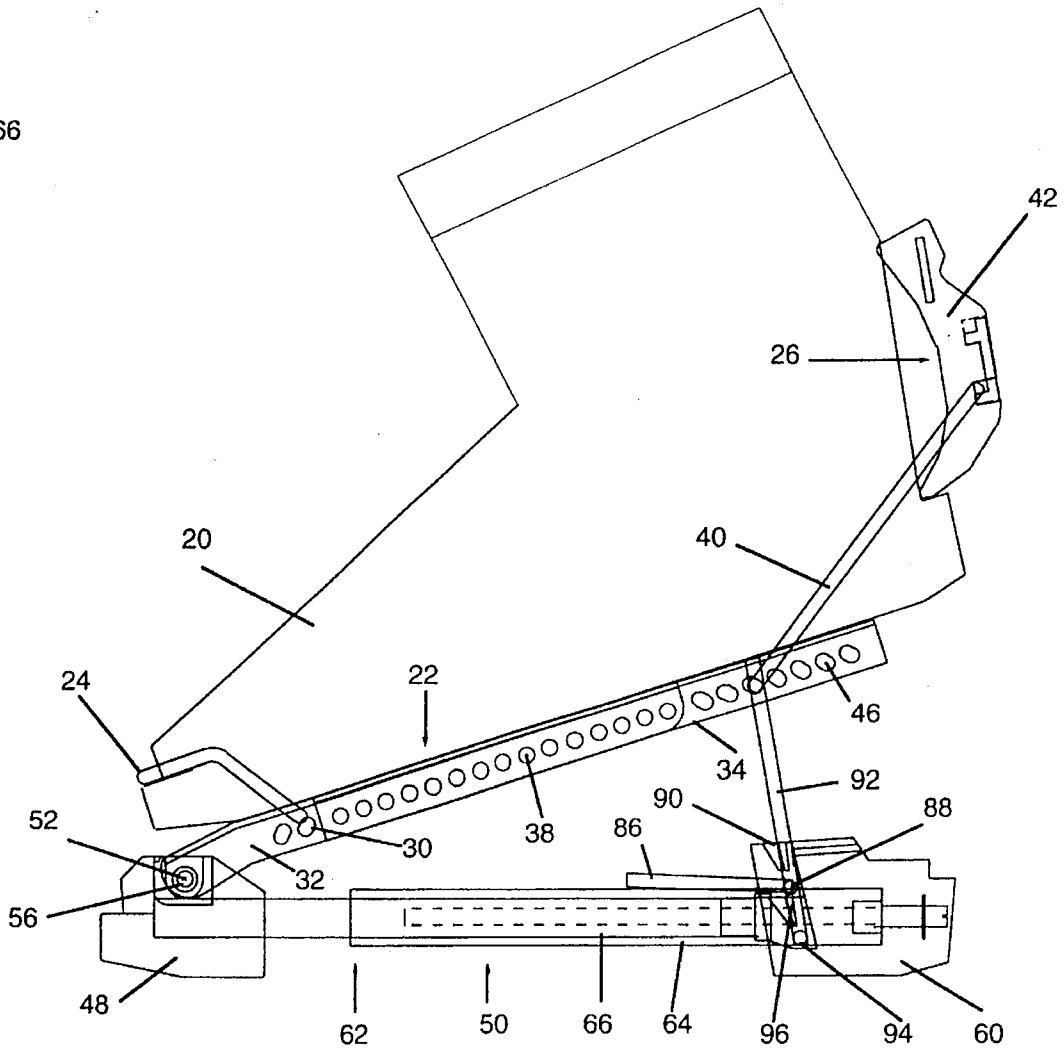

To more readily allows the skier to ascend steep grades, the ski binding adapter provides a mechanism to maintain a minimum heel elevation on the downhill ski boot 20. Referring to FIG. 1, a first televator 86 is provided to maintain a minimum heel elevation of approximately 10 degrees for ascending steep grades. The lower ends of first televator 86 are pivotally mounted in a pair of first televator apertures 88 in the heel piece 60, transverse to the longitudinal axis of the downhill ski boot 20. The first televator 86 may be pivoted to a raised position and secured by a pair of first televator lugs 90 on the heel piece 60. In this raised position, as illustrated in FIG. 9, the upper end of the first televator 86 functions as an elevation stop for the downhill ski boot 20. A second televator 92 which maintains a minimum heel elevation of approximately 17.6 degrees is provided, should still steeper grades be encountered. The lower ends of the second televator 92 are pivotally mounted in a pair of second televator apertures 94 in the heel piece 60, transverse to the longitudinal axis of the downhill ski boot 20. The second televator 92 may be pivoted to a raised position and secured by a pair of second televator lugs 96 on heel piece 60. In this raised position, as illustrated in FIG. 10, the upper end of the second televator 92 functions as a elevation stop for the downhill ski boot 20.

The foregoing specification describes the invention in its preferred embodiment, with many details of the preferred embodiment set forth for illustrative purposes; since variations of the preferred embodiment will be apparent to those skilled in the art, the invention should not be viewed as limited to the form shown and described, but rather as set forth in the following claims.

I claim:

1. In an improved downhill ski binding adapter of the type having a ski boot platform having a forward end and a rearward end, the ski boot platform having means to secure a downhill ski boot to the ski boot platform; a stationary mount unit having a toe end and a heel end, the stationary mount unit being adapted for engagement by a downhill ski binding; a pivot connecting said forward end of said ski boot platform to said toe end of said stationary mount unit about a pivot axis transverse to the longitudinal axis of the ski boot, an improvement comprising means for adjusting the toe and heel end of the stationary mount unit along a longitudinal axis that connects the toe end of the stationary mount unit to the heel end of the stationary mount unit and rotation arresting means for preventing rotation of the toe end of the stationary mount unit relative to the heel end of the stationary mount unit around the longitudinal axis connecting the toe end of the stationary mount unit to the heel end of the stationary mount unit.

2. In an improved downhill ski binding adapter of the type having a ski boob platform having a forward end and a rearward end, the ski boot platform having means to secure a downhill ski boot to the ski boot platform; a stationary mount unit having a toe end and a heel end, the stationary mount unit being adapted for engagement by a downhill ski binding; a pivot connecting said forward end of said ski boot platform to said toe end of said stationary mount unit about a pivot axis transverse to the longitudinal axis of the ski boot, an improvement comprising a telescoping tube assembly, connecting the toe end and the heel end of the stationary mount unit, the tube assembly comprising a first tube of a given length with a second tube of a given length received within the interior of the first tube, the cross sectional inner surface of the first tube being radially asymmetrical, and the cross sectional outer surface of the second tube being radially asymmetrical and corresponding to and engaging the inner surface of the first tube, whereby rotation of the toe end of the stationary mount unit relative to the heel end of the stationary mount unit around the longitudinal axis connecting the toe end of the stationary mount unit to the heel end of the stationary mount unit is prevented.

3. In an improved downhill ski binding adapter of the type having a ski boot platform having a forward end and a rearward end, the ski boot platform having means to secure a downhill ski boot to the ski boot platform; a stationary mount unit having a toe end and a heel end, the stationary mount unit being adapted for engagement by a downhill ski binding; a pivot connecting said forward end of said ski boot platform to said toe end of said stationary mount unit about a pivot axis transverse to the longitudinal axis of the ski boot, an improvement comprising rotation arresting means to prevent rotation of the toe end of the stationary mount unit relative to heel end of the stationary mount unit around a longitudinal axis connecting the toe end of the stationary mount unit to the heel end of the stationary mount unit, and length adjustment means to adjust the length of the stationary mount unit, wherein said length adjustment means includes, a threaded shaft assembly interposed between and connected to the toe end and the heel end of the stationary mount unit, the threaded shaft assembly comprising a threaded aperture, into which is received, an adjustment rod having screw threads formed about its cylindrical length and a retaining shoulder formed near its end.

4. In an improved downhill ski binding adapter as defined in claim 2, further comprising length adjustment means to adjust the length of the stationary mount unit, wherein said length adjustment means includes a threaded shaft assembly received within a barrel formed in the telescoping tube assembly and interposed between and connected to the toe end and the heel end of the stationary mount unit, the threaded shaft assembly comprising, a threaded barrel nut attached to the barrel within the second tube of the telescoping tube assembly, into which is received, an adjustment rod having screw threads formed about its cylindrical length and a retaining shoulder formed near its end, the shoulder of the adjustment rod abuts a forward shoulder of a plain aperture connected to the first tube of the telescoping tube assembly; a tension spring around the end of the adjustment rod abuts a rearward shoulder of the plain aperture, the tension spring being held onto the adjustment rod by a retaining clip.

5. In an improved downhill ski binding adapter as defined in claim 4, wherein said threaded aperture of said threaded shaft assembly includes a threaded barrel nut attached within the barrel through the second tube of the telescoping tube assembly, and said shoulder of said adjustment rod abuts a forward shoulder of a plain aperture connected to the first tube of the telescoping tube assembly, and a tension spring around the end of the adjustment rod abutting a rearward shoulder of the plain aperture, the tension spring being held onto the adjustment rod by a retaining clip.

6. In an improved downhill ski binding adapter of the type having a ski boot platform having a forward end and a rearward end, the ski boot platform having means to secure a downhill ski boot to the ski boot platform; a stationary mount unit having a toe end and a heel end, the stationary mount unit being adapted for engagement by a downhill ski binding; a pivot connecting said forward end of said ski boot platform to said toe end of said stationary mount unit about a pivot axis transverse to the longitudinal axis of the ski boot, an improvement comprising boot position adjustment means to permit the distance between said downhill ski boot and said pivot axis to be altered.

7. In an improved downhill ski binding adapter as defined in claim 6, wherein said boot position adjustment means comprises a toe hook, the lower ends of the toe hook interfitting any pair of a number of pairs of toe clip apertures in said ski boot platform said pairs of apertures varying in distance from said pivot axis.

8. A downhill ski binding adapter of the type having a ski boot platform having a forward end and a rearward end, the ski boot platform having means to secure a downhill ski boot to the ski boot platform; a stationary mount unit having a toe end and a heel end, the stationary mount unit being adapted for engagement by a downhill ski binding; a pivot connecting said forward end of said ski boot platform to said toe end of said stationary mount unit about a pivot axis transverse to the longitudinal axis of the ski boot, an improvement comprising platform length adjusting means to alter the overall length of said ski boot platform.

9. A downhill ski binding adapter as defined in claim 8, wherein said platform adjusting means includes a pair of forward rails, a portion of each of the forward rails overlapping a rear rail bracket, the pair of forward rails being attached to the rear rail bracket by a number of cage fasteners secured through any of a number of adjustment apertures in the pair of forward rails and rear rail bracket.

10. A downhill ski binding adapter as defined in claim 9, wherein said cage fasteners interconnect the pair of forward rails and said cage fasteners interconnect both sides of the rear rail bracket.

11. In an improved downhill ski binding adapter as defined in claim 2, further comprising length adjustment means to adjust the length of the stationary mount unit.

* * * * *

UNITED STATES PATENT AND TRADEMARK OFFICE

CERTIFICATE OF CORRECTION

PATENT NO. : 5,560,633
DATED : October 1, 1996
INVENTOR(S) : Bruce McGowan

It is certified that error appears in the above-indentified patent and that said Letters Patent is hereby corrected as shown below:

Column 4, claim 2, line 2, delete "boob" and insert —boot—.

Signed and Sealed this

Fourth Day of March, 1997

*Attest:*

*Attesting Officer*

BRUCE LEHMAN

*Commissioner of Patents and Trademarks*